US012746430B2

(12) United States Patent
Barbour

(10) Patent No.: US 12,746,430 B2
(45) Date of Patent: Sep. 29, 2026

(54) CARDIO FITNESS MACHINE

(71) Applicant: Lewis Barbour, Harrisburg, PA (US)

(72) Inventor: Lewis Barbour, Harrisburg, PA (US)

( * ) Notice: Subject to any disclaimer, the term of this patent is extended or adjusted under 35 U.S.C. 154(b) by 576 days.

(21) Appl. No.: 17/990,906

(22) Filed: Nov. 21, 2022

(65) Prior Publication Data

US 2024/0108943 A1 Apr. 4, 2024

Related U.S. Application Data

(60) Provisional application No. 63/281,811, filed on Nov. 22, 2021.

(51) Int. Cl.
*A63B 22/20* (2006.01)
*A63B 21/015* (2006.01)
*A63B 23/04* (2006.01)

(52) U.S. Cl.
CPC ..... *A63B 22/20* (2013.01); *A63B 23/047* (2013.01); *A63B 21/015* (2013.01)

(58) Field of Classification Search
CPC ..... A63B 22/20; A63B 21/078; A63B 23/047; A63B 21/015; A63B 21/0722; A63B 21/0618; A63B 21/0626; A63B 21/4035; A63B 2225/093
See application file for complete search history.

(56) References Cited

U.S. PATENT DOCUMENTS 3,247,989 A * 4/1966 Uribe ..... B62B 1/264 414/456
3,765,696 A * 10/1973 Capron ..... B62B 1/18 280/47.25
4,396,188 A * 8/1983 Dreissigacker .... A63B 22/0076 482/73
6,398,235 B1 * 6/2002 Cary ..... B25H 3/00 280/47.35
11,179,591 B1 * 11/2021 Bazargan ..... A63B 69/34
12,233,299 B1 * 2/2025 Chen ..... A63B 21/0618
2008/0203687 A1 * 8/2008 Meyers ..... B62B 1/002 280/47.18
2010/0009814 A1 * 1/2010 Schwartz ..... B62M 1/14 482/62

(Continued)

FOREIGN PATENT DOCUMENTS

EP 3991812 A2 5/2022

OTHER PUBLICATIONS

United States Patent and Tradmeark Office, International Search Report and Written Opinion in corresponding International Application PCT/US2023/080641, Feb. 28, 2024, 14 pages.

(Continued)

*Primary Examiner* — Loan B Jimenez
(74) *Attorney, Agent, or Firm* — Hooker & Habib, P.C.

(57) ABSTRACT

A fitness machine includes an elongate rail, a pair of wheels attached to a front portion of the rail, and a pair of handlebars attached to and extending from a back portion of the rail. The fitness machine can rotate between a horizontal orientation and a vertical orientation to provide bench-press like exercises. The wheels can be locked to enable the fitness machine to function as a drag sled for exercise. Weights can be added to the fitness machine to increase the resistance of the fitness machine for exercise.

21 Claims, 8 Drawing Sheets

(56) References Cited

U.S. PATENT DOCUMENTS

| | | | | |
|---|---|---|---|---|
| 2013/0172159 | A1* | 7/2013 | Stewart | A63B 21/00069 482/92 |
| 2018/0078816 | A1* | 3/2018 | Su | A63B 22/001 |
| 2018/0311522 | A1 | 11/2018 | Schmidt et al. | |
| 2018/0326247 | A1* | 11/2018 | Baumler | A63B 22/20 |
| 2019/0240106 | A1* | 8/2019 | Kapec | A61H 3/04 |
| 2019/0269957 | A1* | 9/2019 | Petrucci | A63B 21/4039 |
| 2019/0351276 | A1* | 11/2019 | Towley | A63B 21/0618 |
| 2020/0238127 | A1* | 7/2020 | Wehrell | A63B 21/40 |
| 2021/0275869 | A1* | 9/2021 | Bass | A63B 22/20 |
| 2022/0072361 | A1* | 3/2022 | Henniger | A63B 21/4029 |
| 2025/0058163 | A1* | 2/2025 | Chen | A63B 21/22 |

OTHER PUBLICATIONS

Performance Strength Designs, Inc., Specimen in US Trademark Registration 4059982 for Prowler trademark, 1 page, Dec. 15, 2020.

* cited by examiner

CARDIO FITNESS MACHINE

RELATED APPLICATION

This application claims priority to and the benefit of U.S. Provisional Patent Application Ser. No. 63/281,811 "Cardio Fitness Machine" filed Nov. 22, 2021 on the filing date of this patent application, which priority application is incorporated by reference as if fully set forth herein.

BACKGROUND OF THE DISCLOSURE

Exercise sleds, such as the PROWLER ° exercise sled manufactured by Performance Strength Designs, Inc., West Columbia, SC are pushed or pulled for exercise and provides low impact cardio and improves strength and overall conditioning. The exercise sled includes a pair of vertical hand grips extending from a base. Weight plates are held on the base. Pushing or pulling the exercise sled using the hand grips moves flat drag plates or runners on the bottom of the base along the ground or other horizontal surface. Sliding friction between the drag plates or runners and the surface proportional to the total weight of the base and weight plates generates resistance to movement of the base.

It would be desirable to provide a fitness machine that provides the benefits of an exercise sled but can also be used for other exercises without the need for specialized accessories.

SUMMARY OF THE DISCLOSURE

Disclosed is a cardio fitness machine that can be pushed or pulled along a surface to provide the benefits of an exercise sled but can also be used for other exercises, such as equivalents to bench presses, without the need for specialized equipment.

A fitness machine in accordance with this disclosure is a wheeled fitness machine having a pair of wheels rotatably mounted on opposite ends of an axle for rotation about a common axis of rotation, the axis of rotation defining a z-axis. The wheels are configured to support the fitness machine on a surface such as a floor.

An elongate rail is attached to the axle between the wheels and spaced away from the axis of rotation, the rail extending along an x-axis perpendicular to the z-axis. The rail is pivotable 90 degrees about the z-axis between a horizontal position wherein the rail is spaced away from and extends parallel with the floor, and a vertical position wherein a front end of the rail is against the floor and the rail x extends from and is perpendicular to the floor. A stand attached to the rail is configured to abut the floor and resist pivotal movement of the rail from its horizontal position towards the floor.

A weight holder is attached to the rail for conjoint pivotal movement with the rail. The weight holder in some embodiments of the fitness machine is configured to allow weights to be removably attached to the rail and to retain the weights on the weight holder when the rail is in either of the horizontal and vertical positions.

The weight holder may be selectably positionable along the rail to selectively vary the distance of weights held by the weight holder from the z-axis. Embodiments of the fitness machine include the weight holder carrying a stand or elongate support leg that maintains the rail in its horizontal position. By having the stand move with the weight holder along the rail, the stand remains under the weights held by the weight holder to minimize bending of the rail.

Handlebars are attached to a back end of the rail away from the wheels. The handlebars extend from the rail away from the floor when the rail is in its horizontal position. Handgrips that extend parallel with the rail are mountable to the handlebars. Handgrips of different weights can be provided that add additional weight to the fitness machine.

Embodiments of the fitness machine may further include the following features, alone or in combination:

- the weight holder is selectively positional along the rail to vary the distance of the weight holder from the z-axis;
- the weight holder is configured to removably hold weights such as, for example, dumbbells and/or weight plates and to hold the weights when the fitness machine is moved between horizontal and vertical orientations;
- a seat removably attached to the rail, the seat being selectively positionable along the rail and enabling a user to sit comfortably on the rail;
- the handlebar including a pair of spaced apart handgrips;
- the handlebar including a pair of arms extending from the forward end of the rail, each arm being configured to removably attach a handgrip to the arm whereby handgrips of different diameter, length, material, cross-section shape, or weight can be attached to the rail;
- the arms being configured to attach a common bar to the ends of the arms, the bar extending transverse to the rail axis that can be gripped by both hands of a user; and
- a brake attached to each wheel that enables a use to selectively lock the wheel with respect to rotation, allow freewheeling of the wheel with respect to rotation, and can enable the rolling resistance of the wheels to vary with respect to rotation;

A fitness machine in accordance with this disclosure has a number of advantages in addition to the fitness machine offering a low-impact workout.

Being wheeled, the fitness machine can be pushed or pulled along the surface to function as a weight sled. Resistance to motion can be selectively varied by adjusting the rolling resistance of the wheels by setting or adjusting the wheel brakes. Because the fitness machine has wheels rather than drag pads or runners, the wheels can more easily traverse uneven or rough surfaces often found outdoors.

A user can stand between the handlebars and, holding the handgrips, pivot the rail from the horizontal position towards and away from the vertical position, raising and lowering the handgrips and weights on the weight holder for weight-lifting exercise. The weight of the weight plates/dumbbells held by the weight holder, the weight of the handgrips, as well as the axial position of the weight holder along the rail can vary the effective resistance of the exercise machine as experienced by the user.

A user can lie prone below the hand grips to pivot the rail from the horizontal position towards and away the vertical position, the fitness machine effectively enabling the user to bench press. The stand can function as a safety device that spots the bench press and prevents the rail or handgrips from falling onto the user.

The user can optionally use a weight training bench to support the user while performing bench presses. If the fitness machine is being used with common bar extending transverse to the rail axis that can be gripped by both hands of a user, the bench press experience can very closely approximate that of a conventional bench press using a weight bar and weight plates.

The fitness machine weight holder can function to store dumbbells or weight plates when the dumbbells or weight plates are not being used. A user can remove the dumbbells or weight plates from the weight holder for use away from the fitness machine and later return them to the weight holder for storage. Multiple weight holders can be attached to the rail to increase the weight capacity and/or the storage capacity of the fitness machine.

The seat of the fitness machine functions as an effective seat for performing exercises with the weights stored on the weight holder. A user for example can perform bicep curls while sitting on the seat, using dumbbells removed from the weight holder and later returned to the weight holder after use. The seat also provides a convenient location for a user to rest prior to, during, or after an exercise session with the fitness machine.

The fitness machine can be stored with the rail in the vertical position to minimize the floor space taken up by the fitness machine when not in use.

Other objects and features of the disclosure will become apparent as the description proceeds, especially when taken in conjunction with the accompanying drawing sheets illustrating one or more illustrative embodiments.

DETAILED DESCRIPTION

Figure 2:
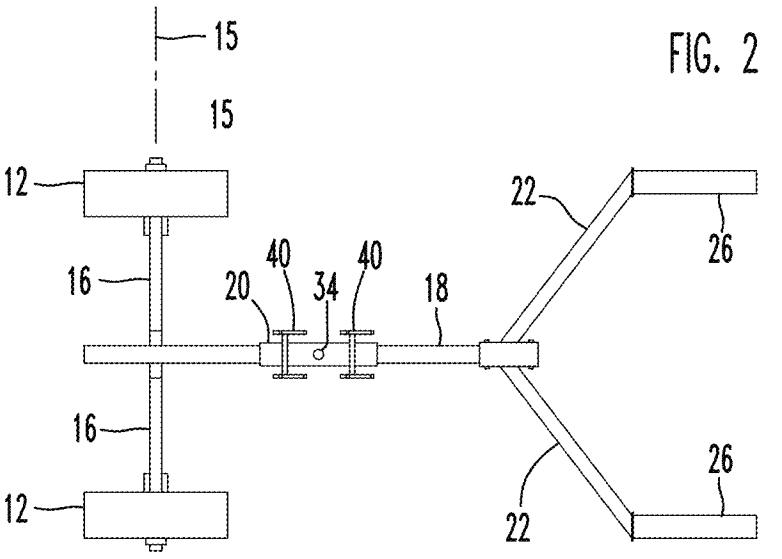
FIG. 2 is a top view of the fitness machine shown in FIG. 1.

FIGS. 1-4 illustrate a fitness machine 10 in accordance with this disclosure. The fitness machine includes a pair of spaced-apart wheels 12 located on opposite ends of an axle 14. The wheels are rotatable about a common axis of rotation defining a z-axis 15 of the fitness machine.

Spaced above the axle 14 between the wheels 12 and spaced radially from the axis or rotation by a pair of support struts 16 is an elongate rail 18. The rail is formed from a rectangular metal bar that extends along a longitudinal axis defining an x-axis 19 of the fitness machine perpendicular to the z-axis 15. The rail is pivotable about the z-axis between horizontal and vertical positions as described below. A weight holder 20 is received on the rail 18 and is movable along the rail x-axis (see FIG. 9 which illustrates alternative possible locations of the weight holder along the rail). The weight holder 20 is formed as a channel receiving the rail and also configured to removably hold a weight or weights used for personal exercise as will be discussed in more detail below.

A pair of handlebars 22 are attached to the back end of the rail 18. The handlebars 22 extend upwardly and away from opposite sides of the rail 18 as viewed in FIG. 1. A pair of handles or arms 24 (see FIG. 11) extend from the free ends of the handlebars parallel with the rail x-axis. Handgrips 26 are removably attached to the arms and extend parallel with the arms.

The weight holder 20 includes a sleeve or channel 28 that receives the rail 18 and a channel stub 30 perpendicular with the channel 28. The channel stub receives an upper end of a stand or elongate support leg 32. The stand is an elongate member extending away from the rail along an axis defining a y-axis 33 of the fitness machine. The y-axis is perpendicular to both the fitness machine z-axis 15 and x-axis 19.

The wheels 12 and the stand 32 are configured to cooperatively support the fitness machine 10 on a horizontal surface S.

Figure 9:
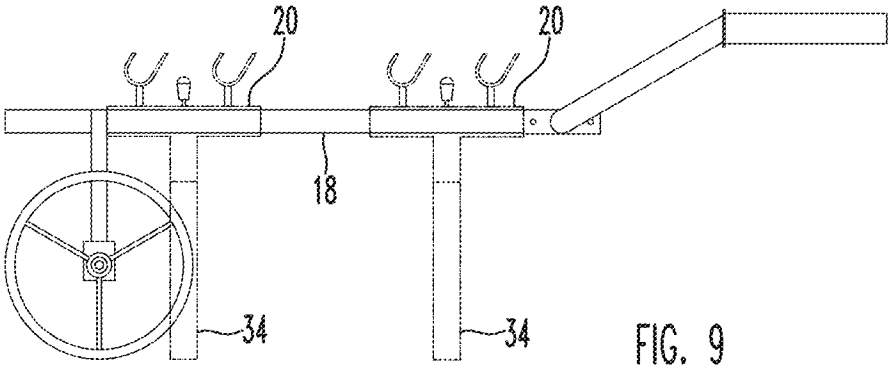
FIG. 9 is similar to FIG. 1 but illustrates in phantom lines alternative placements of the weight holder along the rail of the fitness machine.

The weight holder 20 in the illustrated embodiment is selectively fixedly positioned along the rail 18 by a fastener formed as a handled bolt 34. The bolt extends through aligned pairs of upper and lower through holes spaced along the rail 18 represented by hole centerlines 35 shown in FIG. 5. The holes define user-selectable positions of the weight holder along the rail, FIG. 9 illustrating the left-most and right-most positions of the weight holder along the rail. The holes can also be used to mount accessories (for non-limiting examples, still or video cameras, additional weight holders, storage compartments or bins, or the like) on the frame.

The handled bolt extends into the channel 28. The bolt threadably engages a threaded blind hole extending into the upper end of the stand 32 and tightens the stand against the rail. The weight holder 20 is now fixed with respect to the rail 18 and has conjoint pivotal movement about the z-axis with pivotal movement of the rail.

Figure 1:
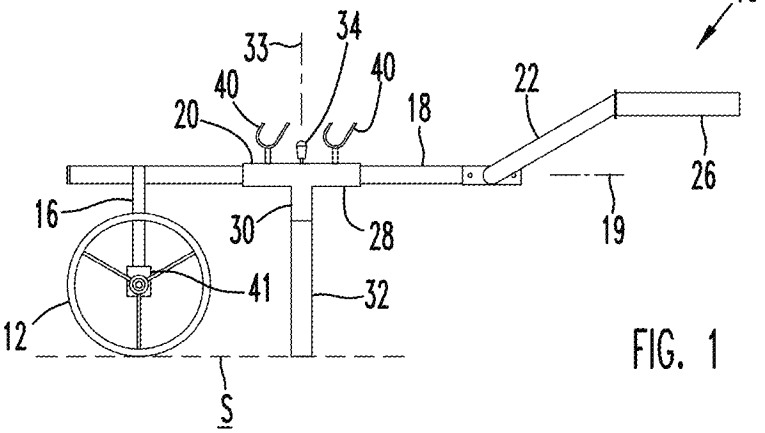
FIG. 1 is a right-side view of an embodiment of a fitness machine in accordance with this disclosure, the fitness machine extending along a horizontal axis.
Figure 4:
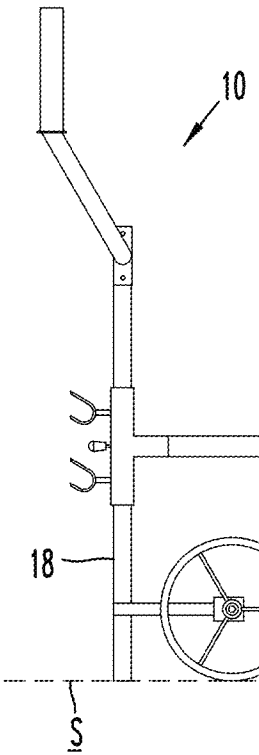
FIG. 4 is similar to FIG. 1 but illustrates the fitness machine rotated 90 degrees about the wheels to extend along a vertical axis.
Figure 3:
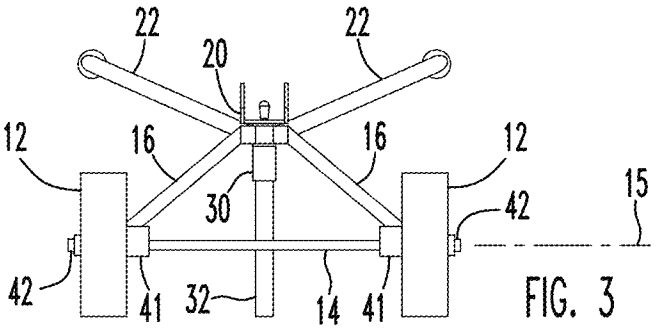
FIG. 3 is a front view of the fitness machine shown in FIG. 1.

FIG. 1 illustrates the fitness machine 10 in a horizontal orientation with the rail 18 in its horizontal position. FIG. 4 illustrates the fitness machine 10 in a vertical orientation with the rail pivoted 90 degrees from its horizontal position to its vertical position.

In FIG. 1 the weight holder 20 is located in an intermediate position along the rail 18 between the support struts 16 and the handlebars 22. The rail 18 in the horizontal position is spaced above and parallel with the surface S. The stand 32 supports the rail 18 in its horizontal position against the surface S and prevents further pivotal movement of the rail past the horizontal position and towards the surface S.

Figure 5:
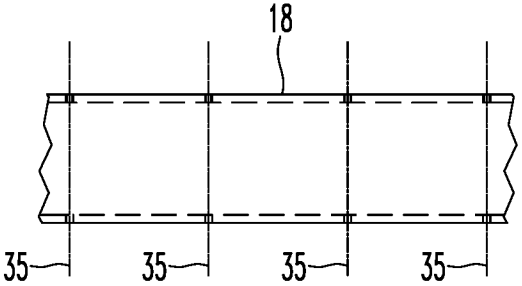
FIG. 5 is a side view of a portion of the rail of the fitness machine shown in FIG. 1.
Figure 8:
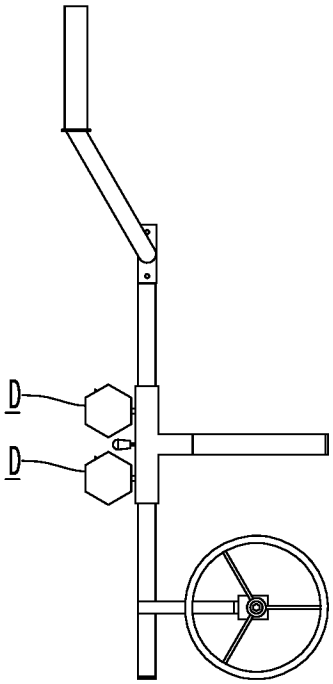
FIGS. 6, 7, and 8 are similar to FIGS. 1, 2, and 4 but illustrate the weight holder of the fitness machine holding a pair of dumbbells.

The rail 18 in its vertical position shown in FIG. 5 extends vertically away from the horizontal surface S. The rail extends beyond the axis of rotation of the wheels 12 to a front end of the rail that cooperates with the wheels 12 to support the fitness machine in its vertical orientation against the surface S as shown in FIG. 4. The rail prevents further pivotal movement of the rail from the horizontal position shown in FIG. 1 and past the vertical position shown in FIG. 4.

The weight holder 20 can be selectively positioned along the rail 18. FIG. 9 illustrates the weight holder at extreme left and extreme right positions along the rail as viewed in the figure. The stand 32 remains with the weight holder and so remains located underneath the weight holder regardless of the axial position of the weight holder along the rail. In this way the stand most directly supports weights carried by the weight holder when the fitness machine 10 is in its horizontal orientation.

Figure 7:
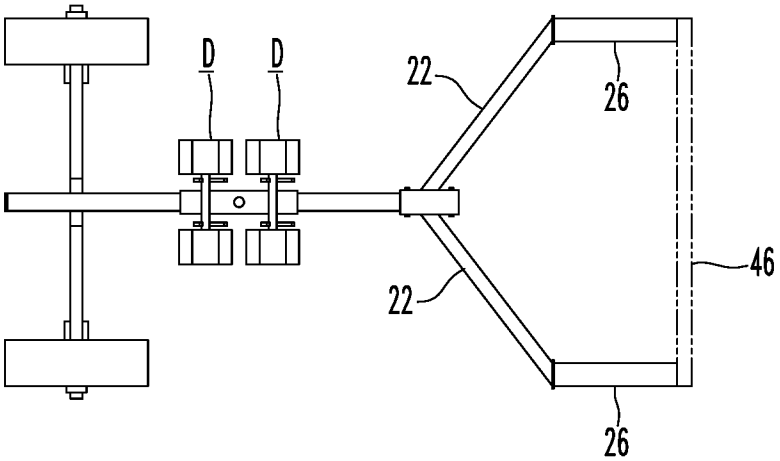
Figure 6:
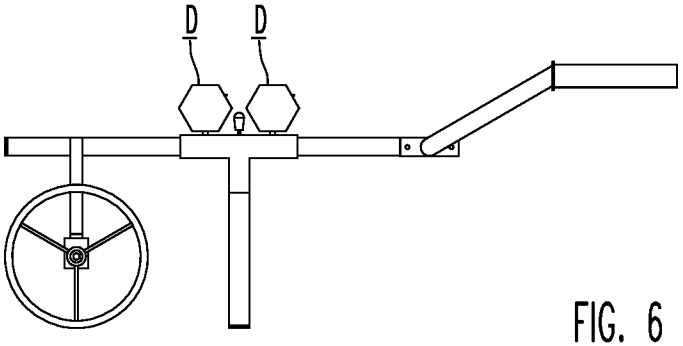

The illustrated weight holder 20 is configured to hold a pair of dumbbells. The weight holder 20 is shown without dumbbells in FIGS. 1-4 and is shown holding a pair of dumbbells D in FIGS. 5-7. Each dumbbell is received and held by a pair of forks 40 that are configured to retain the dumbbells in the forks throughout the range of pivotal motion of the fitness machine between horizontal and vertical orientations.

Other embodiments of the weight holder 20 can be designed to hold weight plates, dumbbells and weight plates, or other types of weights.

Each wheel 12 includes a wheel hub 41 that receives the axle 14. Each wheel hub is the location of a disc brake assembly 42 described in more detail later. The disc brake assemblies enable setting the rolling resistance of the wheel about the axle. The disc brakes can be set to lock the wheels with respect to the axle, can be set to allow essentially freewheeling of the wheels with respect to the axle, or can be set to vary rolling resistance of the wheels with respect to the axle between the wheels being in locked and freewheeling states.

Figure 10:
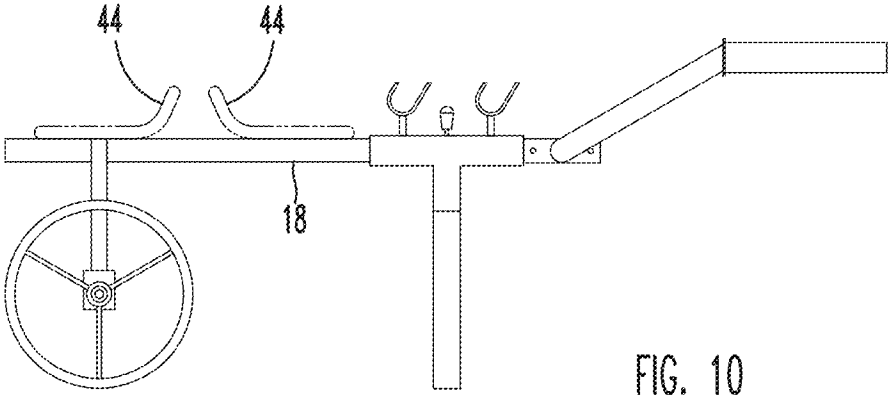
FIG. 10 is similar to FIG. 1 but illustrates in phantom lines alternative placements of a seat on the rail of the fitness machine.

The fitness machine 10 can also include a seat 44 selectively positionable along the rail 18. FIG. 10 illustrates the seat 44 in phantom lines mounted on the rail 18 in different positions and facing in different directions. The seat can be attached to the rail by tightening a screw passing through one of the pairs of aligned holes in the rail from the bottom of the rail and into a threaded sleeve of the seat. The illustrated seat 44 is designed not to obstruct movement of the rail 18 to its vertical position when the seat 44 is located over the struts 16 as shown in FIG. 10.

Figure 11:
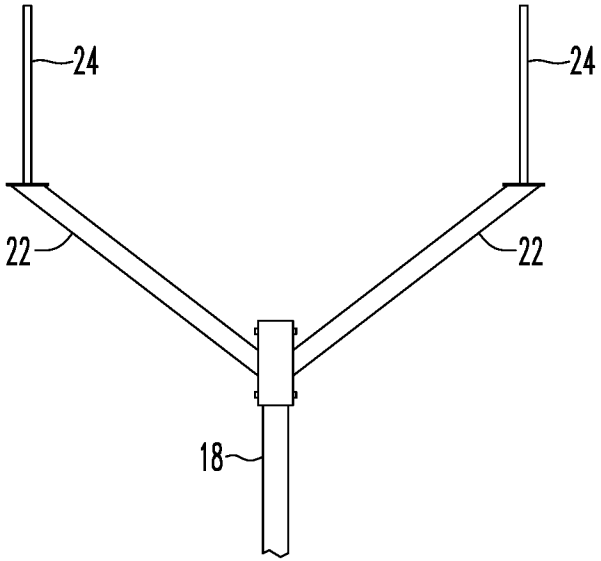
FIG. 11 is a view of the handlebars of the fitness machine shown in FIG. 1, the handgrips removed from the arms of the handlebars.

FIG. 11 illustrates the handlebar arms 24 attached to the handlebars 22 without handgrips being attached to the arms. Pairs of handgrips of different diameters, lengths, and weights can be attached to the arms 24; for example both a pair of relatively heavy handgrips and a pair of relatively light handgrips can be provided with the fitness machine 10.

Figure 12:
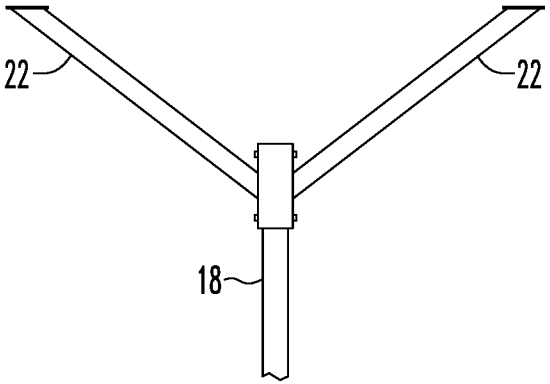
FIG. 12 is similar to FIG. 11 but with the arms also removed from the handlebars.

The arms 24 are themselves also removably attached to the handlebars 22. FIG. 12 illustrates the handlebars without the arms being attached. This enables different types, shapes, or sizes of arms to be attached to the handlebars. For example, arms that extend perpendicular to the rail x-axis when attached to the handlebars could be provided.

Figure 13:
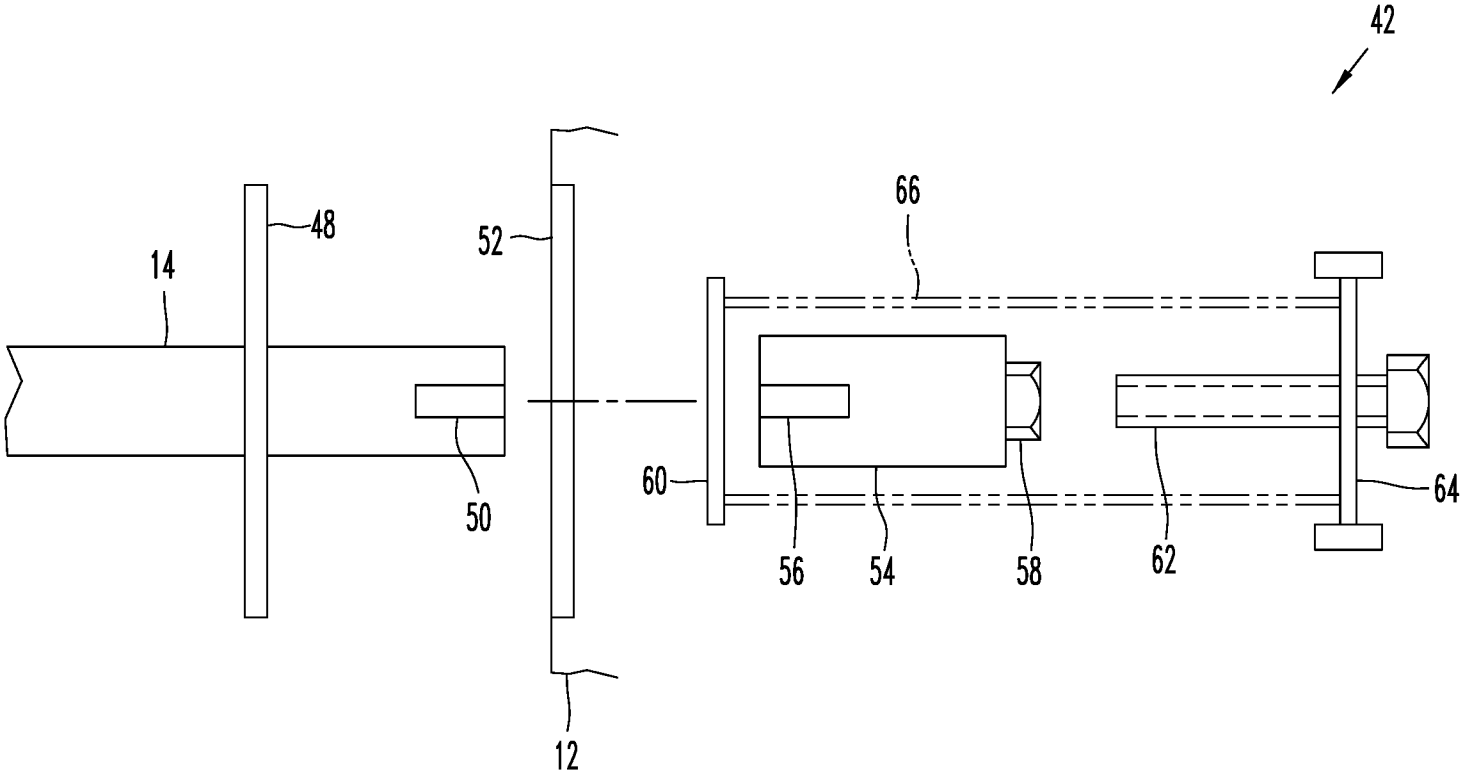
FIG. 13 is an exploded view of one of the disc brake assemblies of the fitness machine shown in FIG. 1.

FIG. 13 illustrates a disc brake assembly 42 associated with a tire 12. The disc brake assembly includes a first disc 48 fixed to the axle 14 spaced from the end of the axle that receives the tire 12. An axial slot 50 is formed in the end of the axle and opens on opposite sides of the axle.

The axle 14 extends through a hole in a second disc 52 fixed to and rotatable with the tire 12. The first and second discs 48, 52 face each other and engage each when generating frictional force resisting relative rotation of the two discs.

A sleeve cap 54 closely receives the end of the axle 14. The sleeve cap includes a slot 56, similar to the axle slot 50 on the end of the sleeve cap receiving the axle. A nut 58 is centered on the opposite end of the sleeve cap. A radially-enlarged inner washer 60 has a central hole that receives the end of the sleeve cap receiving the axle 14. The inner washer has a pair of opposing teeth (not shown) received in the axle slot 50 and sleeve cap slot 56 that non-rotatably connect the sleeve cap with the axle. A threaded bolt 62 carrying a radially enlarged combination outer washer 64 is threaded into the axle 14. A compression spring 66 is captured between the inner and outer washers 60, 64.

The bolt 62 threads into the spring cap nut 58 and into the blind hole of the axle 14, locating the spring cap 54 close to the tire disc 52. The inner washer 60 is axially movable in the cooperating axle and sleeve cap slots 50, 56. The head of the bolt 62 is spaced from the spring cap nut 58. The outer nut 64 can be turned by hand to move axially along the bolt 62 and thereby selectively define the compressed length of the compression spring 66. The compression spring generates spring force that urges the inner washer against the tire disc 52, which in turn urges the tire disk 52 against the axle disc 48.

When the outer washer 64 is against the head of the bolt, the compression spring 68 is at its longest working length. The generated spring force is essentially zero. The tire and axle discs essentially do not resist rotation of the tire 12 relative to the axle 14. When the outer washer 64 is against the sleeve cap nut 58, the compression spring is at its shortest working length. The generated spring force is relatively high. The tire and axle discs generate sufficient static friction between them to prevent rotation of the tire relative to the axle. The user selectively positions the outer washer along the bolt to achieve the desired rotational resistance applied to the tire by the disc brake assembly.

The illustrated fitness machine 10 has the following exemplar, non-limiting dimensions:

- height of the rail above the floor as shown in FIG. 1, 18 inches;
- tire diameter 17 inches;
- height of center line of handles above the floor as shown in FIG. 1, 28 inches;
- width between the center lines of the handles, 30 inches; and
- length of the rail, 48 inches.

The fitness machine 10 can be used like a weight sled by pushing or pulling the fitness machine along a surface. The rolling resistance of the wheels 12 can be set to a desired resistance against movement. A user can lift the rail 18 enough for the stand 32 to be spaced above the bottom of the wheels 12 and to cause the user to lift the dumbbells/weight plates/handle grips while moving the fitness machine. Handlebar arms configured to extend perpendicular to the rail x-axis could also be used when the fitness machine is used by pushing or pulling the machine. A bar 46 (shown in phantom in FIG. 7) extending transverse to the rail 18 can also be attached to the arms or handlebars, enabling a user to push or pull the fitness machine 10 with both hands on the bar.

Figure 14:
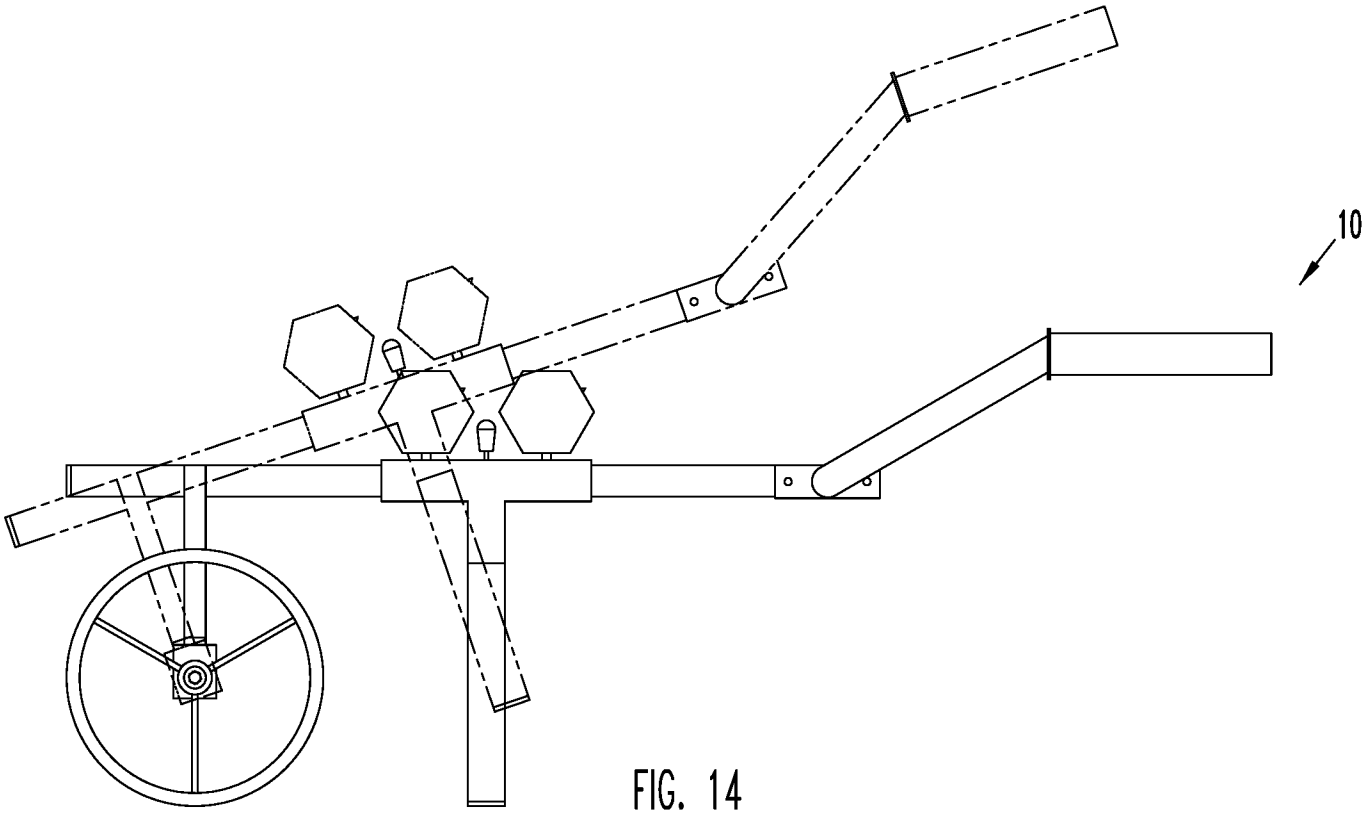
FIG. 14 is similar to FIG. 6 but also illustrates in phantom lines pivotal displacement of the fitness machine from its horizontal orientation while carrying the dumbbells.

The fitness machine 10 can also be used as essentially a stationary piece of exercise equipment as shown in FIG. 14. A user stands or sits between the handgrips 26 and uses the handgrips to pivot the rail 18 from the horizontal position towards and away from the vertical position, thereby raising and lowering weights on the weight holder for weight-lifting exercise. Resistance can be varied by changing the amount of weight held by the weight holder(s), the position of the weight holder(s) along the rail 18, and the weight of the handgrips.

The fitness machine 10 can also be used for bench presses as previously discussed above.

Figure 15:
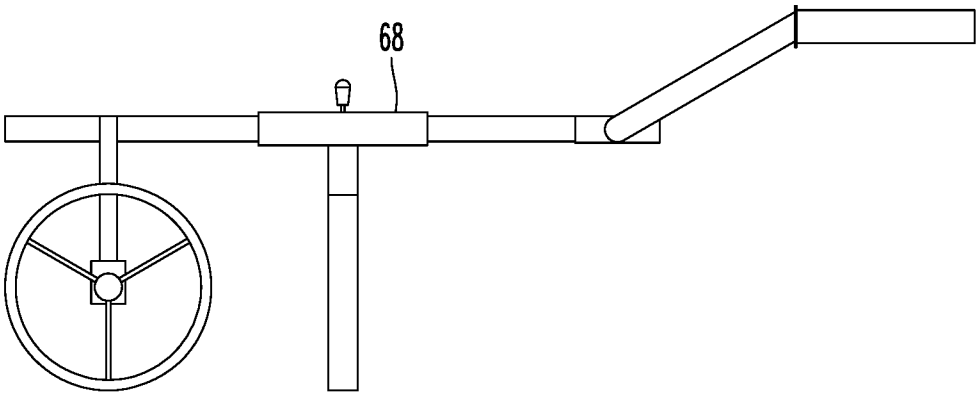
FIG. 15 is similar to FIG. 1 but the fitness machine is provided with a channel that does not store free weights.

The fitness machine 10 can be used without the channel holder 20 holding free weights; for example, for use like a weight sled and relying solely on the resistance generated by the disc brake assemblies. The fitness machine 10, alternatively, can utilize a channel 68 (see FIG. 15) that is similar to the channel 28 but is not designed to hold or store free weights.

Figure 16:
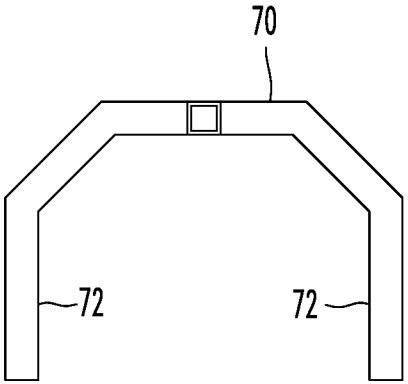
FIG. 16 is a front view of an alternative channel for the fitness machine.
Figure 17:
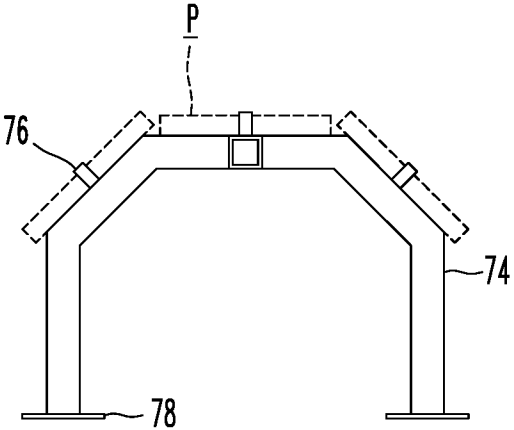
FIG. 17 is a front view of an alternative channel similar to that shown in FIG. 16 but modified to hold weight plates.

The fitness machine 10 can also be provided with a channel that receives a stand providing multi-point support of the fitness machine on a floor. FIG. 16 illustrates a channel 70 similar to the channel 68 that receives a stand having a pair of permanent support legs 72. The support legs are each similar to a support leg 32, and in the illustrated embodiment are spaced about 68 inches apart. FIG. 17 illustrates a channel 74 similar to the channel 70 but modified to hold weight plates on pins 76 extending from the channel. Each support leg also includes an enlarged bottom plate 78 that distributes the support of the weight plates over a larger floor area.

Figure 19:
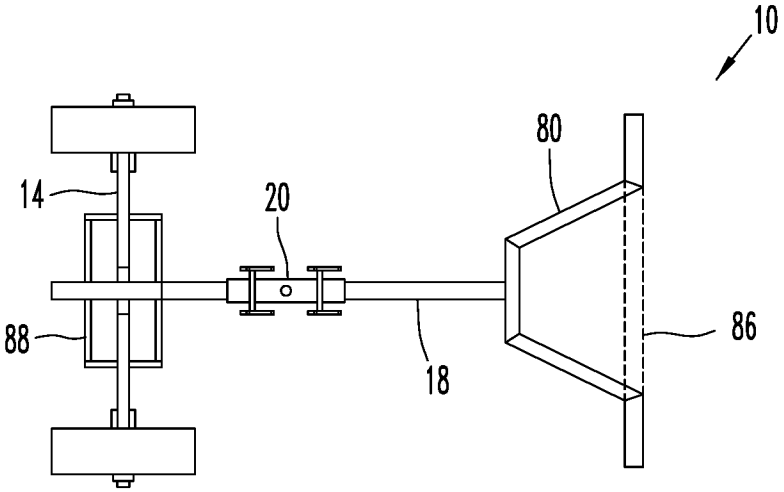
FIG. 19 is a top view of the fitness machine modified for performing bench presses.
Figure 20:
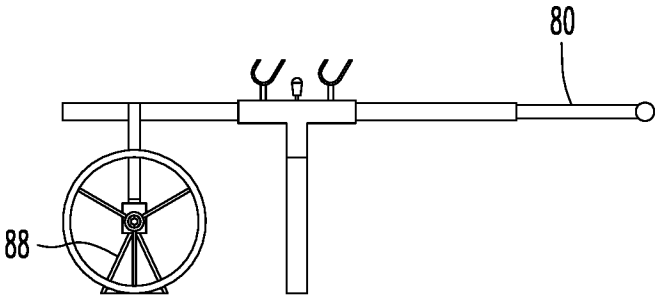
FIG. 20 is a side view of the fitness machine as shown in FIG. 19.
Figure 18:
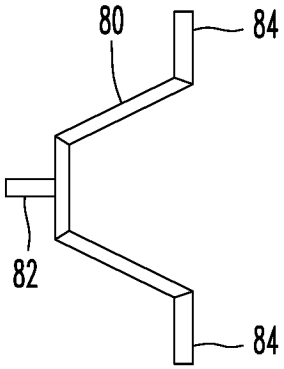
FIG. 18 is a top view of an alternative set of handlebars for use with the fitness machine.

FIGS. 18-20 illustrate an alternative configuration of the fitness machine 10 for performing bench presses. This configuration utilizes a pair of handlebars 80 intended to replace the pair of handlebars 22 when performing a bench press. The handlebars 80 includes a stub shaft 82 received in the frame rail 18. The handlebar grips 84 are attached to the free ends of the handlebars axially in-line with the rail 18. The handlebar grips 84 may also be connected by a bar 86 (shown in dashed lines in FIG. 19) that enables a user to change grip along the bar 86.

A removable kickstand 88 is installed on the axle 14. The kickstand can pivot about the axle 14 to lift the tires off the ground while supporting the fitness machine 10 as shown in FIGS. 19 and 20 when performing bench presses.

A user can lie on a weight bench extending away from the fitness machine 10 to perform bench presses, pivoting the fitness machine in a manner similar to that shown in FIG. 14. A channel is preferably used that holds weights while performing bench presses. FIGS. 19 and 20 illustrate use of the channel 20 with the handlebars 80.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, environment of use, and the like, as well as such changes and alterations that fall within the purview of the following claims.

What is claimed is:

1. A fitness machine comprising:

a single elongate rail formed from a single elongate metal bar, the single elongated rail having a length extending between opposite front and back ends of the single elongated rail, the single elongated rail extending along and defining an x-axis of the fitness machine extending from the front end to the back end of the single elongated rail, the single elongated rail having an outer surface extending along the x-axis and surrounding the x-axis for a portion of the length of the single elongated rail;

a pair of wheels attached to the single elongated rail adjacent a front portion of the single elongated rail and a pair of struts, each individual strut of the pair of struts being attached to the single elongated rail and extending from the single elongated rail to a respective individual wheel of the pair of wheels, the individual wheel rotatably attached to the individual strut, the pair of wheels rotatable about a common axis of rotation, the axis of rotation defining a z-axis of the fitness machine perpendicular to the x-axis, the single elongated rail being disposed between the pair of wheels with the single elongated rail spaced from the z-axis;

a stand connected to the single elongated rail, the stand extending away from single elongated rail along and defining a y-axis of the fitness machine, the y-axis perpendicular to the x-axis and the z-axis;

a pair of handlebars attached to a portion of the single elongated rail disposed at the back end of the single elongated rail, the pair of handlebars extending away from the single elongated rail from opposite sides of the single elongated rail;

the pair of wheels and the stand being configured to cooperatively support the fitness machine on a horizontal surface whereby the single elongated rail is spaced from the horizontal surface and extends parallel with the horizontal surface and the pair of handlebars extend away from the horizontal surface as they extend away from the single elongated rail when the fitness machine is on the horizontal surface, the fitness machine being in a horizontal orientation when the fitness machine is supported by the pair of wheels and stands on the horizontal surface;

the pair of wheels and the front end of the single elongated rail being configured to cooperatively support the fitness machine on the horizontal surface whereby the single elongated rail is against the horizontal surface and extends perpendicularly away from the horizontal surface when the fitness machine is on the horizontal surface, the fitness machine being in a vertical orientation when the fitness machine is supported by the pair of wheels and the front end of the single elongated rail is on the horizontal surface; and the fitness machine being pivotable between the horizontal orientation of the fitness machine and the vertical orientation of the fitness machine.

2. The fitness machine of claim 1 wherein the pair of handlebars each includes a respective arm extending from the handlebar.

3. The fitness machine of claim 2 comprising a respective handgrip removably attached to each of the arms.

4. The fitness machine of claim 3 wherein the respective handgrips comprise a first pair of handgrips, and the fitness machine comprises a second pair of handgrips selectively attachable to the pair of handlebars, the second pair of handgrips having a different weight than the first pair of handgrips.

5. The fitness machine of claim 2 wherein the arms extend from the handlebars parallel with the x-axis.

6. The fitness machine of claim 3 wherein the arms extend from the handlebars perpendicular with the x-axis.

7. The fitness machine of claim 1 wherein the stand is selectively axially positionable along at least a portion of the single elongated rail.

8. The fitness machine of claim 7 wherein the fitness machine comprises a channel receiving the single elongated rail, the channel being selectively positionable along the at least a portion of the single elongated rail, the stand being attachable to the channel whereby positioning the channel along the single elongated rail also establishes the position of the stand along the single elongated rail.

9. The fitness machine of claim 7 wherein the single elongated rail comprises a plurality of holes spaced along the x-axis and the stand is fixed to the single elongated rail by a fastener extending through a hole and into the stand.

10. The fitness machine of claim 1 comprising a seat attached to the single elongated rail, the seat being configured to enable a user to sit on the seat while the fitness machine is in the horizontal orientation.

11. The fitness machine of claim 10 wherein the seat is selectively axially positionable along at least a portion of the single elongated rail.

12. The fitness machine of claim 10 comprising a weight holder being attached to the single elongated rail.

13. The fitness machine of claim 1 comprising a weight holder being attached to the single elongated rail, the weight holder being configured to removably hold a weight or weights used for personal exercise, the weight holder being configured to retain weight or weights held by the weight holder while the fitness machine pivots between the horizontal orientation and the vertical orientation of the fitness machine.

14. The fitness machine of claim 13 wherein the weight holder comprises at least one pair of forks or at least one pin.

15. The fitness machine of claim 1 comprising a brake assembly associated with the pair of wheels, the brake assembly being configured to enable a user to selectively set a rolling resistance of the pair of wheels, the brake assembly capable of: (a) locking the pair of wheels with respect to rotating about the axis of rotation, (b) allowing freewheeling of the pair of wheels with respect to the axis of rotation, and (c) selectively varying the rolling resistance of the pair of wheels between locked wheels and freewheeling wheels.

16. The fitness machine of claim 15 wherein the brake assembly comprises a respective brake operatively connected to each wheel of the pair of wheels, each of the brakes being configured to enable the user to selectively set the rolling resistance of the respective wheel connected to the respective brake.

17. The fitness machine of claim 1 comprising a bar attached to the handlebars and extending between the handlebars.

18. The fitness machine of claim 1 wherein each handlebar of the pair of handlebars includes a respective arm extending from the handlebar, the bar attached to the arms.

19. The fitness machine of claim 1 comprising a kickstand operable to relieve the pair of wheels from supporting the fitness machine on the horizontal surface.

20. The fitness machine of claim 1 wherein the stand comprises at least one support leg.

21. The fitness machine of claim 1 wherein the single elongated rail has a rectangular cross section.

* * * * *